US007267708B2

(12) United States Patent
Chabek et al.

(10) Patent No.: US 7,267,708 B2
(45) Date of Patent: Sep. 11, 2007

(54) RIGID ELECTRODE IONIZATION FOR PACKED BED SCRUBBERS

(75) Inventors: William Chabek, Cleveland, OH (US); Nathaniel Dickinson, Strongsville, OH (US)

(73) Assignee: Air-Cure Dynamics, Inc., Strongsville, OH (US)

( * ) Notice: Subject to any disclaimer, the term of this patent is extended or adjusted under 35 U.S.C. 154(b) by 190 days.

(21) Appl. No.: 11/110,607

(22) Filed: Apr. 20, 2005

(65) Prior Publication Data

US 2006/0236858 A1 Oct. 26, 2006

(51) Int. Cl.
*B03C 3/019* (2006.01)
*B03C 3/41* (2006.01)

(52) U.S. Cl. ..... 95/64; 55/DIG. 38; 95/70; 95/71; 96/53; 96/55; 96/95

(58) Field of Classification Search ..... 96/52, 96/53, 55, 95; 95/64, 70–72; 55/DIG. 38
See application file for complete search history.

(56) References Cited

U.S. PATENT DOCUMENTS 2,935,375 A * 5/1960 Boucher ..... 423/210
3,633,337 A 1/1972 Walker et al.
3,763,632 A * 10/1973 Imris ..... 96/95
3,874,858 A 4/1975 Klugman et al.
3,958,958 A 5/1976 Klugman et al.
4,072,477 A 2/1978 Hanson et al.
4,093,430 A 6/1978 Schwab et al.
4,110,086 A 8/1978 Schwab et al.
4,222,748 A 9/1980 Argo et al.
4,265,641 A 5/1981 Natarajan
4,473,380 A * 9/1984 Voliva et al. ..... 95/66
4,911,737 A * 3/1990 Yehl et al. ..... 95/81
4,976,749 A * 12/1990 Adamski et al. ..... 95/63
5,147,423 A * 9/1992 Richards ..... 96/62
5,282,885 A 2/1994 Cameron
5,364,457 A 11/1994 Cameron
5,395,430 A 3/1995 Lundgren et al.
5,941,465 A * 8/1999 Richards ..... 239/690.1

(Continued)

FOREIGN PATENT DOCUMENTS

DE 3415489 C1 * 6/1985 ..... 96/55

*Primary Examiner*—Richard L. Chiesa
(74) *Attorney, Agent, or Firm*—Grimes & Battersby, LLP

(57) ABSTRACT

An ionizing particulate scrubber is provided for the removal of particulate from a gaseous exhaust stream, said scrubber including two sections: a charging section and a collection section. The charging or ionizing section includes one or more cylindrical tubular ground chambers each with a rigid threaded rod electrode extending through the center thereof. A transformer/rectifier (T/R) is provided to supply high voltage DC power to the electrode such that the cylindrical tubular ground chambers act as the ground to enable a corona to form on the threaded rod electrode. As the gas stream passes through the current flowing from the electrode to the cylindrical tubular ground chambers walls, the particulate contained within the stream is electrostatically charged. The collection system includes either a fixed or fluid bed packed section which is constantly irrigated from above. Ground rods in the packing and liquid sump allow the entire section to act as a grounded collector for the charged particulate. The gas stream and charged particulate are immediately sent from the charge section to the collection section of the system, and clean gas is then passed through an entrainment separator section to remove liquid droplets.

19 Claims, 3 Drawing Sheets

U.S. PATENT DOCUMENTS 6,110,256 A * 8/2000 Reynolds et al. ..... 95/4
6,508,861 B1 * 1/2003 Ray ..... 95/79
6,858,064 B2 * 2/2005 Bologa et al. ..... 95/65
2004/0139853 A1 7/2004 Bologa et al.

* cited by examiner

RIGID ELECTRODE IONIZATION FOR PACKED BED SCRUBBERS

BACKGROUND OF THE INVENTION

1. Field of the Invention

The present invention relates generally to a system and method for enhancing particulate collection from the gaseous exhaust stream of an industrial process, and more particularly to such a system and method whereby the collection is enhanced by charging the particulate and utilizing electrical forces to increase collection in a packed bed scrubber system.

2. Description of the Prior Art

Many industrial processes, particularly thermal processes such as the incineration of waste materials or high temperature production of materials such as glass fibers, emit small or sub-micron-sized particulate in their gaseous exhaust stream, which particulate is normally considered hazardous by the Environmental Protection Agency and regulated as such. Accordingly, there has long been a need for systems and methods for removing such particulate from the exhaust stream prior to its entry into the atmosphere.

Various systems for electrostatically charging the particulate have been developed, such as described in U.S. Patent App. No. 20040139853 which was published on Jul. 22, 2004 in the name of Bologa; et al. for "Apparatus for the electrostatic cleaning of gases and method for the operation thereof" discloses an apparatus comprising three-conduit sections: a ionization and cleaning section in which the particles contained in water-saturated air are ionized and then conducted through a chamber with grounded walls so that part of the particles are deposited on these walls; an additional cleaning section which includes grounded tubes past which the gas is conducted to remove additional charged particles; and a filter section in which dry remaining fine particles are removed from the gas stream.

It should be appreciated that such systems for electrostatically charging particulate matter has long been known in the industry. For example, U.S. Pat. No. 5,395,430 which issued to Lundgren, et al. on Mar. 7, 1995 for "Electrostatic precipitator assembly" discloses an electrostatic precipitator assembly including a tubular collector and an electrode suspended therein, wherein the electrode includes a substantially cylindrical collector portion and a charging portion which includes a rod and a charging disk, and further wherein the gap between the charging disk and the collector is at least as great as the gap between the collector portion of the electrode and the collector.

Two more examples of electrostatic cleaning systems are shown in U.S. Pat. No. 5,364,457 which issued to Cameron on Nov. 15, 1994 for "Electrostatic gas cleaning apparatus" and U.S. Pat. No. 5,282,885 which issued to Cameron on Feb. 1, 1994 for "Electrostatic gas cleaning process and apparatus" both of which disclose processes and apparatuses for collecting particles or droplets in which a charging device and condensation equipment are combined to provide a cleaning apparatus that operates at a cost less than conventional apparatuses.

Another example is U.S. Pat. No. 4,265,641 which issued to Natarajan on May 5, 1981 for "Method and apparatus for particle charging and particle collecting" which discloses a method and apparatus for charging and collecting submicron particles whereby the particles are charged by a needle-to-plate ionizer having offset rows of needles which are spaced from the plate. Charged particles are collected in a collecting section having a deflector electrode and a pair of collecting plates wherein the deflector electrode includes a conductor embedded in a dielectric material having a dielectric constant greater than 1, which dielectric material suppresses arcs between the deflector electrode and the collecting plates.

In yet another example, U.S. Pat. No. 4,222,748 which issued to Argo, et al. on Sep. 16, 1980 for "Electrostatically augmented fiber bed and method of using" discloses an apparatus including a grounded fiber bed of 50 to 1000 micron average diameter fibers packed to a bed, an electrostatic or ionizing field means upstream of the fiber bed to place an electrical charge on the particulates, and irrigation means for the fiber bed, and optionally the grounded electrodes of the electrostatic means as well, to flush collected particulates from the fiber bed and optionally from the grounded electrodes. In operation, particulates are charged in the electrostatic means and the charged particulates are collected in the fiber bed where the electrical charge is dissipated through the irrigating liquid/particulates mixture so that no significant space charge effect is allowed to develop in the fibers of the fiber bed and re-entrainment of particulates is avoided.

The use of a venturi to increase the velocity of the gas stream was taught in U.S. Pat. No. 4,110,086 which issued to Schwab, et al. on Aug. 29, 1978 for "Method for ionizing gases, electrostatically charging particles, and electrostatically charging particles or ionizing gases for removing contaminants from gas streams," which discloses the use of a venturi to increase the velocity of contaminated gases and guides the gases past a high, extremely dense electrostatic field presented perpendicular to the gas flow and extending radially outward between a central, accurately sized disc electrode and the surface of the venturi throat. Downstream, charged particles are collected by a wet scrubbing process or electrostatic precipitator. A similar device is disclosed in U.S. Pat. No. 4,093,430 which also issued to Schwab, et al. on Jun. 6, 1978 for "Apparatus for ionizing gases, electrostatically charging particles, and electrostatically charging particles or ionizing gases for removing contaminants from gas streams."

Similarly, U.S. Pat. No. 4,072,477 which issued to Hanson, et al. on Feb. 7, 1978 for "Electrostatic precipitation process" discloses an electrostatic precipitator which operates on the principle of mutual repulsion of charged particles to a grounded wall wherein the solid particle laden gas stream enters a collecting section where additional particles in the form of droplets, normally water, are injected in the form of a fine spray into the solid particle laden gas stream, and the solid particles and the additional particles are electrostatically charged either by conventional corona or by injecting the droplets from a charged nozzle and as the charged particles pass through the grounded section of the precipitator, a fraction of the water particles and solids are forced to the grounded wall by electric fields created by the space charge. Precipitated solid particles are entrained in the coalesced water which runs down the walls and is drained from the precipitator.

In the 1970s, Ceilcote APC developed the Ionizing Wet Scrubber (IWS) to address sub-micron particulate removal from gaseous emission streams. The IWS system is described, in U.S. Pat. No. 3,958,958 which issued to Klugman, et al. on May 25, 1976 for "Method for electrostatic removal of particulate from a gas stream" discloses a method including a packed wet scrubber through which a scrubbing liquid such as water is flowed vertically downwardly and through which gas to be cleaned is flowed in a direction transverse to the direction of flow of the scrubbing liquid. The stream of gas to be treated is ionized prior to its flow through the wet scrubber to provide particles in the gas stream with an electrical charge of a given polarity, and upon flow of the gas stream through the wet scrubber, the charged particles in the gas stream are carried into close proximity with and are attracted to the scrubbing liquid and/or packing elements as a result of attraction forces between the charged particles and the electrically neutral packing elements and liquid. A similar device was disclosed in U.S. Pat. No. 3,874,858, which issued to Klugman, et al. on Apr. 1, 1975.

The IWS system combined an electrostatic charge section followed by a packed bed collection system. This system was very complex and expensive to operate. Other electrostatic collection methods have been utilized, but they fall short when collecting particulate in the sub-micron size range. Tri-Mer has developed a Cloud Chamber Scrubber (U.S. Pat. Nos. 5,147,423, 5,941,465) which utilizes ionization of particulate in a mesh electrode, followed by collection on finely atomized liquid droplets.

As shall be appreciated, the prior art fails to specifically address either the problem or the solution arrived upon by applicant.

SUMMARY OF THE INVENTION

This invention is intended to offer distinct advantages over existing air pollution control technologies as well as advantages over the ionizing wet scrubber technology.

In Relation to the Overall Air Pollution Control Industry, this Invention Offers the Following:

It is a primary object of the present invention to provide a system and method for enhancing particulate collection from a gaseous exhaust stream by charging the particulate and utilizing the electrical forces to increase collection in a packed bed scrubber system.

It is another object of the present invention to provide such a system and method that is capable of collecting even sub-micron sized particles.

It is still another object of the present invention to provide such a system and method that reduces the installed cost over conventional electrostatic scrubber devices.

It is yet a further object of the present invention to provide such a system and method wherein the charge section is separate from the collection section, thereby allowing for the collection of particulate and other contaminants, such as acid gases, condensable and soluble VOCs, etc., at the same time and using the same equipment, when using a packed bed scrubber as the collection section.

It is yet another object of the present invention to provide such a system and method that uses a concentric tube arrangement for the charge section using a rigid threaded rod electrode.

It is a further object of the present invention to provide such a system and method that uses a short profile charge section to minimize any collection of particles which would negatively effect the charge section performance.

It is also an object of the present invention to provide such a system and method that uses a vertical countercurrent design which reduces the area required.

In Relation to the Existing Ionizing Wet Scrubber Technology, this Invention Offers the Following:

It is another object of the present invention to provide such a system and method that reduces the operating cost over conventional ionizing wet scrubber technology.

It is a further object of the present invention to provide such a system and method that reduces the equipment footprint as compared to conventional ionizing wet scrubber technology.

It is also an object of the present invention to provide such a system and method that reduces the continual maintenance associated with the multiple plate and wire design currently used in ionizing wet scrubbers and some electrostatic scrubber technologies.

It is another object of the present invention to provide such a system and method that uses cylindrical ground sections rather than irrigated plates to eliminate the requirement of constant flushing of the plates to remove particulate and keep the charge section dry and allow more consistent high voltage supply to the ionizer section.

It is still another object of the present invention to provide such a system and method that uses heavy threaded rod electrodes which do not require constant tensioning in place of wire electrodes which were prone to breakage in certain applications.

It is another object of the present invention to provide such a system and method that uses fluid bed packing which is self-cleaning and will thereby not plug as particulate material is collected from the gas stream.

It is still another object of the present invention to provide such a system and method that allows the concentrated solids to be collected into a slurry form and thereby minimize the liquid waste generated during operation.

It is another object of the present invention to provide high velocity ionization of the gas stream, minimizing the residence time in the charge section. This also minimizes particulate collection in the charge area where it will reduce high voltage input.

It is yet another object to allow easy retrofit of existing packed bed scrubbers by adding a charge section to enhance particulate removal.

To the accomplishments of the foregoing objects and advantages, the present invention, in brief summary comprises an ionizing particulate scrubber for the removal of particulate from a gaseous exhaust stream, said scrubber comprising two sections: a charging section and a collection section. The charging or ionizing section comprises one or more short cylindrical tubular ground chambers each with a rigid threaded rod electrode extending through the center thereof. A transformer/rectifier (T/R) is provided to supply high voltage DC power to the electrode such that the cylinder walls act as the ground to enable a corona to form on the threaded rod electrode. As the gas stream passes through the current flowing from the electrode to the cylinder walls, the particulate contained within the stream is electrostatically charged. The gas stream and charged particulate are immediately sent from the charge section to the collection section of the system. The collection system comprises either a fixed or fluid bed packed section which is constantly irrigated from above using a liquid recirculation system and integral sump tank. The packed bed provides an extended surface for collection of particulate by a combination of mechanisms. Some larger particulate is collected by inertial impaction on the packing surface. Smaller particulate is collected by Coulomb force and image force attraction to the neutral surfaces of the packing material. Ground rods in the packing and sump keep the packing and recirculated liquid neutral to allow the entire section to act as a grounded collector for the charged particulate. Clean gas is then passed through an entrainment separator section to remove liquid droplets. The clean gas is exhausted from the system either to atmosphere, or to further treatment.

Multiple stages of ionizing followed by collection may be staged for higher particulate collection efficiency.

DETAILED DESCRIPTION OF THE PREFERRED EMBODIMENTS

Figure 1:
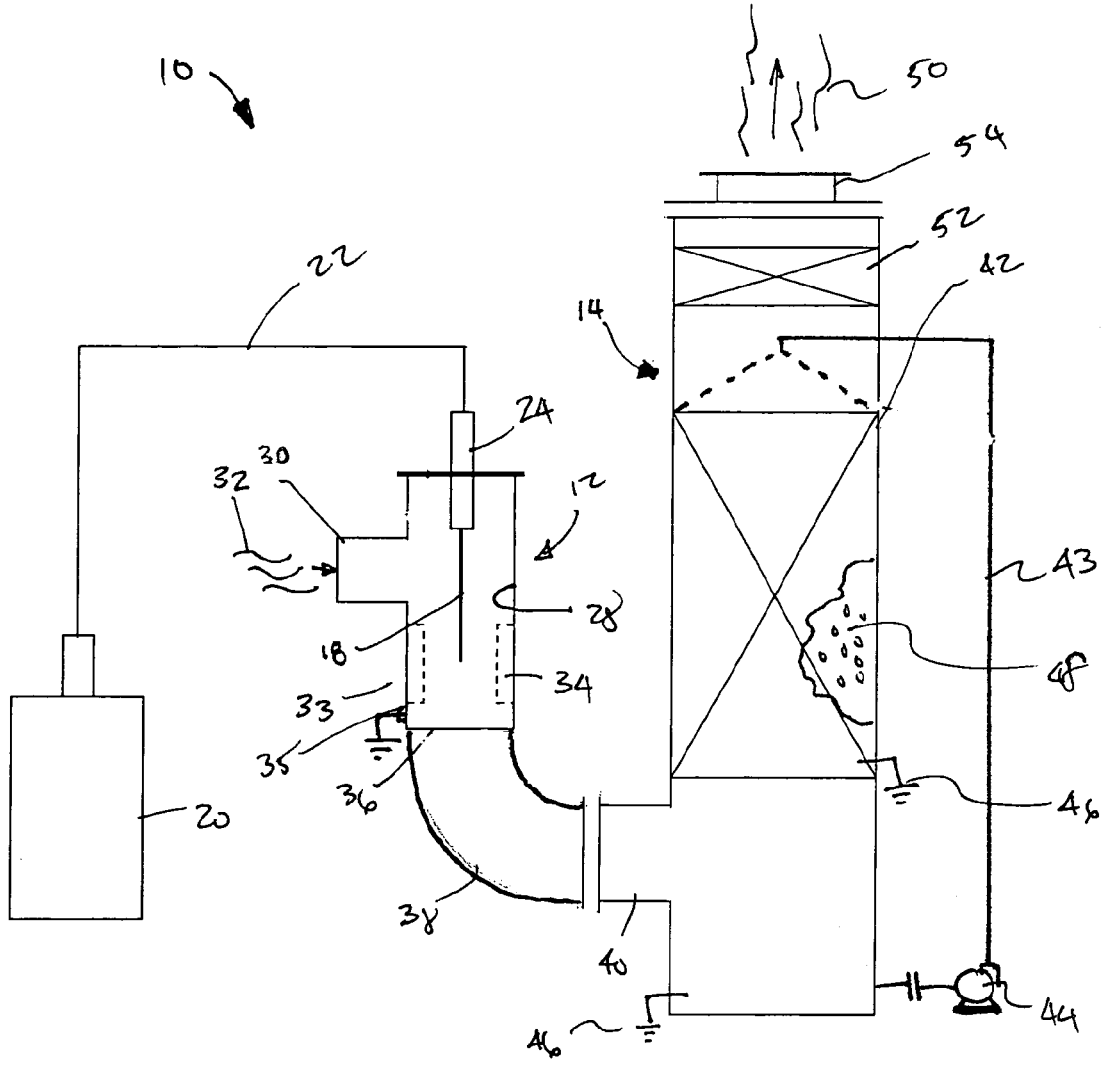
FIG. 1 is schematic diagram of the ionizing particulate scrubber of the present invention showing the two sections thereof.
Figure 2:
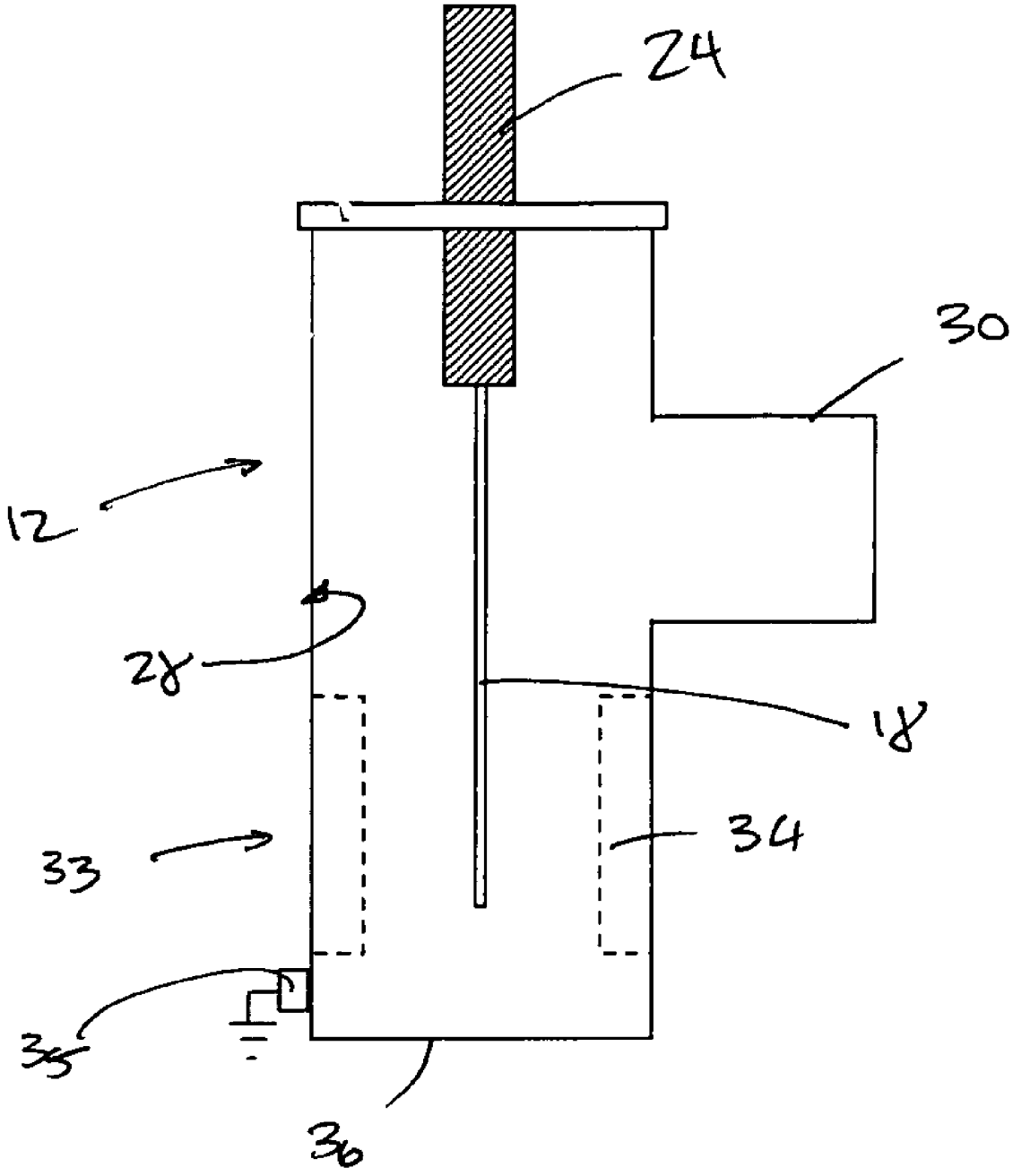
FIG. 2 is a schematic diagram of the ionizer section of the ionizing particulate scrubber of the present invention.

Referring to the drawings and, in particular, to FIG. 1 thereof, the ionizing particulate scrubber is provided and is referred to generally by reference numeral 10. The scrubber 10 comprises a charging or ionizing section 12 and a collection section 14. The importance of having two separate sections 12, 14 cannot be overemphasized inasmuch as it allows for the collection of particulate and other contaminants, such as gases, water soluble and condensable VOCs, etc., at the same time while using the same equipment, provided said collection section 14 is a packed bed scrubber. The charging section 12 comprises an ionizer housing 28, with one or more cylindrical tubular ground chambers 34 each with a rigid threaded rod electrode 18 extending through the center thereof. The threaded rod electrode 18 provides an extremely long effective electrode length as the entire thread length is the actual ionization emitter for particle charging.

High voltage DC power is provided to the electrode 18 by a transformer/rectifier 20, which is connected through an insulator 24 to the electrode 18 by HV cable 22. Insulators 24 having through-put bushings are provided to support the electrodes that extend within the ionizer housing 28 and through the tubular ground chambers 34. In the preferred embodiment, system 10 utilizes a high voltage DC transformer/rectifier 20 to supply power and a commercial control package to control high voltage and react to prevent or minimize sparkover.

The electrode 18 and the tubular ground chambers 34 cooperate to enable the formation of a corona on the threaded rod electrode 18 when DC power is supplied by the transformer/rectifier 20, with the tubular ground chambers 34 acting as the ground. The tubular ground chambers 34 are connected to and external ground through a ground lug 35.

Figure 3A:
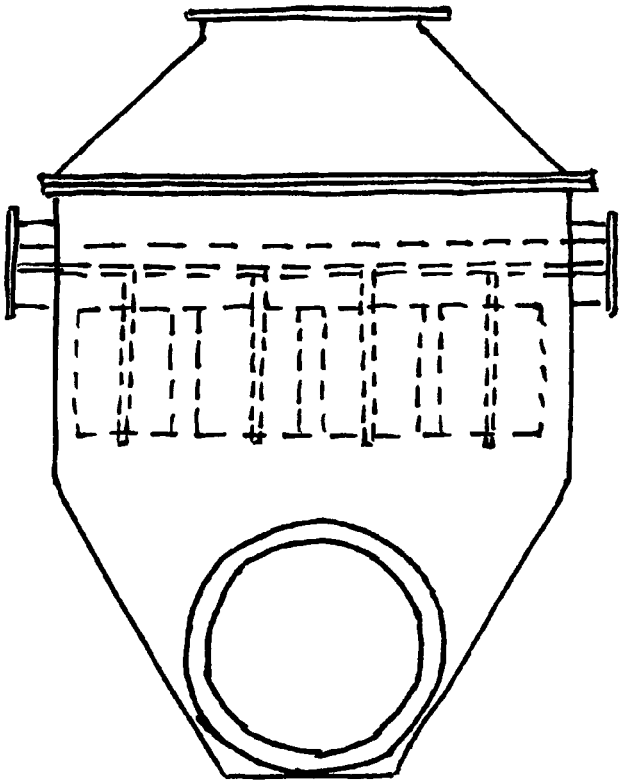
FIG. 3A is a front elevational view showing a typical arrangement for multiple charge tubes in the ionizing particulate scrubber of the present invention and FIG. 3B is a side elevational view showing the arrangement of FIG. 3A.
Figure 3B:
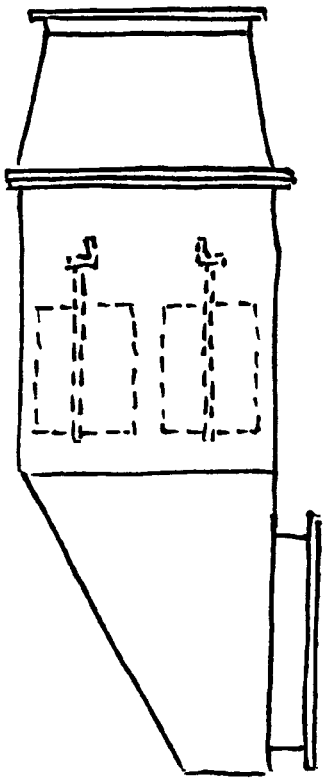

A gas inlet 30 is disposed either from side of the ionizer housing 28, or on the top of the ionizer housing as shown in FIG. 3. The inlet 30 is positioned so as to allow the gas stream 32 containing particulate matter to flow through the tubular ground chambers 34 and past the rigid threaded rod electrode 18. As the gas stream 32 passes through the current flowing from the electrode 18 to the tubular ground chambers 34 within the ionizer section 33 of the ionizer housing 28, the particulate contained within the stream 32 is electrostatically charged. In the preferred embodiment, the ionizer section 33 is relatively short—between 6 and 12 inches—so as to minimize the collection of any charge particles which would negatively affect the ionizer section 33 performance.

In the preferred embodiment, the inner diameter of the gas inlet 30 will vary depending upon the velocity and volume of the gas stream 32. The tubular ground chamber 34 diameter is approximately 12 inches; although it should be appreciated that larger and smaller diameters may be used depending upon the velocity and volume of the gas stream 32.

Once charged, the gas stream 32 exits the ionizer housing 28 through the outlet chamber or transition 36 to the conduit 38, which conduit 38 leads to the collection inlet 40 of the collection section 14. The collection system 14 comprises either a fixed or fluid bed packed section 42 which is constantly irrigated from above. Scrubbing liquid flows down through the packed section 42 and is collected in the liquid sump 45. A recirculation pump 44 and recycle piping 43 are provided for continuous irrigation of the packed section 42.

The packed section 42 and the liquid sump 45 are grounded through ground lugs 46. This allows the entire packed section and the recirculated liquid to act as grounded collectors for the charged particulate in the gas stream 32. The gas stream 32 containing the charged particulate passes through the packed section 42 where the charged particles are removed from the gas stream 32 by means of inertial impaction, Coulomb force and image force attraction of the charged particles to the grounded packing 48. The resulting clean gas 50 is then passed through an entrainment separator section 52 to remove liquid droplets. The clean gas is exhausted from the collection section 14 through the collection exhaust 54, where it is either discharged to the atmosphere or is further treated. Multiple stages of ionizing followed by collection may be staged for higher particulate collection efficiency by connecting charging sections 12 and collection sections 14 in series.

In the preferred embodiment, the packed section 42 uses a vertical countercurrent design which reduces the area or footprint required. Also in the preferred embodiment, the vertical orientation of the collection system 14 gives the equipment a smaller footprint and enhances collection efficiency. This system 10 also allows high ionization velocities and high collection velocities which further dramatically reduces the overall footprint of the system. Fluid bed packing 48 is preferably used because it is self cleaning and will therefore not plug as the solids are collected. Such packing 48 also allows the concentrated solids to be collected into a slurry form, thereby minimizing the liquid waste generated during operation.

It should be obvious to one skilled in the art that there are added benefits for having separate charging and collection sections 12, 14 as provided for herein. For example, ionizing sections 12 may be easily retrofitted to existing packed bed collection systems including the currently installed Ceilcote IWS systems. This will reduce the mechanical complexity of the systems, enhance performance and allow increased capacity. The large installed base of vertical and horizontal flow packed bed scrubbers also offers an opportunity to add ionizer sections to chemical scrubber systems to enhance particle collection. Ionizing sections 12 may be oriented with vertical or horizontal gas flow to take best advantage of site conditions. Velocities may be varied based on application requirements. Diameter and length of the cylindrical ground chambers 34 may be varied based on application to change residence time in the charge section.

What is claimed is:

1. An ionizing particulate scrubber for removing particulate from a gaseous exhaust stream, said scrubber comprising:

a charging section comprising one or more cylindrical tubular chambers each having a rigid threaded rod electrode extending therethrough, each of said electrodes including threading substantially along the length of said rod and each being the sole means for producing a corona thereon when provided with high voltage DC power, wherein said cylindrical tubular ground chambers include inside ionizer housing walls that serve as a ground for the formation of said corona; and a collection section including an irrigated packed section.

2. The ionizing particulate scrubber of claim 1, wherein said ionization chamber includes an ionization section within which said particulate in said gas stream is charged.

3. The ionizing particulate scrubber of claim 2, wherein said ionization section is between 6 and 12 inches in length.

4. The ionizing particulate scrubber of claim 1, wherein said high voltage DC power is provided by a transformer/rectifier.

5. The ionizing particulate scrubber of claim 4, wherein said transformer/rectifier provides high voltage DC power.

6. The ionizing particulate scrubber of claim 5, wherein said transformer/rectifier is electrically connected to said rigid threaded rod electrode by HV cable or buss bar.

7. The ionizing particulate scrubber of claim 6, wherein said HV cable is attached to said rigid threaded rod electrode using a through-put insulator.

8. The ionizing particulate scrubber of claim 1, wherein said cylindrical tubular chamber includes a gas inlet and a gas outlet, said gas outlet being positioned at the end of said chamber opposite said gas inlet.

9. The ionizing particulate scrubber of claim 1, further including a conduit from said charging section to said collection section.

10. The ionizing particulate scrubber of claim 1, wherein said packed section is selected from the group consisting of fixed bed and fluid bed.

11. The ionizing particulate scrubber of claim 1, wherein said collection section further includes a recirculation pump.

12. The ionizing particulate scrubber of claim 11, further including ground rods connected to said irrigated packed bed and said liquid sump.

13. The ionizing particulate scrubber of claim 1, wherein said collection section further includes an entrainment separator.

14. The ionizing particulate scrubber of claim 13, wherein said collection section further includes a collection exhaust for the removal of any liquid droplets from said gas stream.

15. The ionizing particulate scrubber of claim 1, wherein said irrigated packed section is vertically or horizontally disposed.

16. The ionizing particulate scrubber of claim 1, wherein said irrigated packed section uses a vertical counter-current design.

17. An ionizing particulate scrubber for removing particulate from a gaseous exhaust stream, said scrubber comprising:

a high voltage transformer/rectifier capable of producing high voltage DC power;

a charging section comprising one or more cylindrical tubular chambers each having a rigid threaded rod electrode extending therethrough, each of said electrodes including threading substantially along the length of said rod and each being electrically connected to said transformer/rectifier by HV cable and insulator and each being the sole means for producing a corona thereon when provided with high voltage DC power, wherein said cylindrical tubular chambers include inside cylinder walls that serve as a ground for the formation of said corona, wherein said tubular chamber includes an ionization section within which said particulate in said gas stream is charged, each of said tubular chambers further including a gas inlet and a gas outlet, said gas outlet being positioned at the end of said chamber opposite said gas inlet;

a collection section including an irrigated fixed or fluid bed packed section, an entrainment separator, a sump pump and a collection exhaust for the removal of any liquid droplets from said gas stream; and a conduit from said charging section to said collection section.

18. A method for removing particulate from a gaseous exhaust stream, said method comprising the steps of:

providing an ionizing particulate scrubber comprising:

a charging section comprising one or more cylindrical tubular chambers each having a rigid threaded rod electrode extending therethrough, each of said electrodes including threading substantially along the length of said rod and each being the sole means for producing a corona thereon when provided with high voltage DC power, wherein said cylindrical tubular chambers include inside cylinder walls that serve as a ground for the formation of said corona; and a collection section including an irrigated packed section;

charging said electrodes to create said corona;

passing said gaseous stream containing said particulate through said tubular chamber past said electrodes to thereby electrostatically charge said particulate;

passing said gaseous stream from said charging section to said collection section;

passing said gaseous stream containing said charged particulate through said irrigated packed section to thereby remove said particulate; and exhausting said gaseous stream without said particulate out of said collection section.

19. The method of claim 18, further including the step of passing said gaseous stream through multiple charging sections and collection sections.

* * * * *